United States Patent [19]

Slonicki

[11] Patent Number: 4,532,668

[45] Date of Patent: Aug. 6, 1985

[54] FOOT SCRUBBER WITH SOAP DISPENSER FOR USER WHO CANNOT REACH HIS FEET

[76] Inventor: Alex Slonicki, 1050 Tower Rd., Winnetka, Ill. 60093

[21] Appl. No.: 544,532

[22] Filed: Oct. 24, 1983

[51] Int. Cl.[3] ..... A47K 7/00

[52] U.S. Cl. ..... 15/104.92; 15/21 B; 15/161

[58] Field of Search ..... 15/21 R, 21 B, 21 C, 15/97 R, 104.92, 161, 320, 410; 128/62 R, 258; 401/163, 165

[56] References Cited

U.S. PATENT DOCUMENTS

| | | | |
|---|---|---|---|
| 2,730,737 | 1/1956 | Herman | 15/97 R |
| 3,188,669 | 6/1965 | Beardslee | 15/320 |
| 3,416,178 | 12/1968 | James | 15/104.92 |
| 3,543,747 | 12/1970 | Gustafson | 15/104.92 |
| 3,548,439 | 12/1970 | Berst | 15/104.92 |
| 3,973,286 | 8/1976 | Logan | 15/21 D |
| 4,225,996 | 10/1980 | Hoos | 15/21 B |

*Primary Examiner*—Philip R. Coe

*Assistant Examiner*—Arthur D. Dahlberg

*Attorney, Agent, or Firm*—Michael N. Meller

[57] ABSTRACT

A foot scrubber comprising a housing, brushes attached to the inner surfaces of the housing, at least one suction cup for attaching the housing to a surface, a compressible dispenser for dispensing liquid soap when pressure is applied, an arm for applying pressure on the compressible means, and a handle rigidly connected to the arm by a substantially vertical shaft. The arm can be vertically displaced in a downward direction, thereby compressing the compressible dispenser, only when the handle is in a predetermined angular position. The suction cups attach the housing to a surface by a partial vacuum formed by pressing on the handle when it is not in the predetermined angular position. The suction cups comprise a valve which is in a closed condition when the partial vacuum is present. To dissipate the partial vacuum and thereby release the suction cups, the valve is placed in an opened condition. This is achieved by means of a release cable connected to a release lever rotatably arranged on the handle.

11 Claims, 10 Drawing Figures

FOOT SCRUBBER WITH SOAP DISPENSER FOR USER WHO CANNOT REACH HIS FEET

TECHNICAL FIELD

The present invention relates to manually operated foot scrubbers for use by persons who are unable to bend to reach their feet.

BACKGROUND OF THE ART

Apparatus for cleaning feet are known in the prior art. For example, U.S. Pat. No. 2,852,793 to Shelton discloses a foot brush according to which one foot is placed in the cleaning device while the other foot is used to depress a button for dispensing soap.

U.S. Pat. No. 3,548,439 to Berst discloses a foot scrubbing device according to which soap is dispensed onto the foot to be cleaned by depressing a pump in reciprocating fashion with the other foot.

The Shelton and Berst foot scrubbers both suffer from the drawback that the user must stand on one foot while dispensing soap by means of the other foot. This is an unstable and undesirable position for a person who is physically handicapped by back problems.

U.S. Pat. No. 3,973,286 to Logan discloses a foot cleaning apparatus having a soap-filled bellows which is depressed by the foot to be cleaned. This foot controls the pivoting of a treadle, which is operatively coupled to the bellows. This system suffers from the disadvantage that, because the treadle on which one foot rests is pivotable, the user is not provided with a stable footing, which is of critical importance to a partially incapacitated person who risks further injury if he falls in a shower.

Finally, U.S. Pat. No. 3,416,178 to James discloses a foot washer having a hand-operated squeezable soap dispenser. Although this system provides a firm footing by securing the cleansing unit to a shower board, no means are provided for ensuring that the user maintain his balance.

All of the above disadvantages are eliminated in the foot cleansing device of the present invention. An elongated handle is attached to the housing, by which the user is able to manually maintain a stable upright position. In addition, the handle can be operated to dispense soap. Releasable suction cups are provided for securing the housing to the shower stall or bathtub. These suction cups are releasable by way of a lever located on the handle. Thus, the user can install, operate, and remove the foot cleansing device of the present invention without bending and while maintaining a stable position.

SUMMARY OF THE INVENTION

The object of the present invention is to provide a foot scrubber for use by persons who are unable to reach their feet.

Another object of the present invention is to provide a foot scrubber with a soap dispenser, which dispenses liquid soap in response to downward pressure applied on the handle by the user when the handle is in a predetermined angular position.

A further object of the present invention is to provide a foot scrubber with suction means by which the scrubber is attached to a surface, the suction means being affixed to the surface by partial vacuum in response to downward pressure applied on the handle by the user when the handle is not in the aforementioned predetermined position.

A further object of the present invention is to provide a foot scrubber having a handle allowing the user to stabilize his position while one foot is being washed.

A final object of the present invention is to provide a foot scrubber with suction means by which the scrubber is attached to a surface, the suction means being releasable by means of a lever located on the handle.

The foot scrubber according to the present invention comprises a housing, brushes attached to the inner surfaces of the housing, suction means for attaching the housing to a surface, compressible means for dispensing liquid soap when pressure is applied, means for applying pressure on the compressible means, and a handle rigidly connected to the means for applying pressure by a substantially vertical shaft. The means for applying pressure can be vertically displaced in a downward direction, thereby compressing the compressible means for dispensing, only when the handle is in a predetermined angular position.

The suction means attaches the housing to a surface by a partial vacuum formed by pressing on the handle when it is not in the predetermined angular position. The suction means comprises a valve means which is in a closed condition when the partial vacuum is present. To dissipate the partial vacuum and thereby release the suction means, the valve means is placed in an opened condition. This is achieved by means of a release cable connected to a release lever rotatably arranged on the handle.

A guideway means defines a slot and a bore in which the means for applying pressure and the shaft, respectively, travel in a vertical direction. A projection, integrally constructed with the guideway means, extends into the bore. The shaft is provided with an axial groove and a circumferential groove which communicate and which ride on the projection. This arrangement allows the shaft and means for applying pressure to be displaced vertically in a downward direction only when the axial groove and tenon are aligned. This prevents accidental dispensation of liquid soap when the handle is pushed down by the user, while maintaining his balance or while securing the suction means to a surface.

BRIEF DESCRIPTION OF THE DRAWINGS

The present invention will be described in detail with reference to the following drawings.

DESCRIPTION OF THE PREFERRED EMBODIMENT

Figure 1:
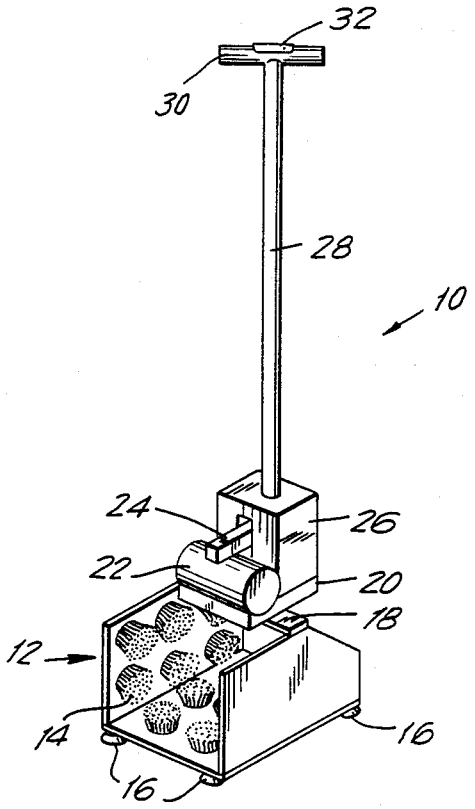
FIG. 1 shows a perspective view of the foot scrubber according to the present invention.

The foot scrubber according to the present invention is generally denoted by the numeral 10 in FIG. 1. Housing 12 comprises a rectangular bottom plate and a pair of parallel side walls, each of which has a plurality of brushes 14 affixed to its inner surface. A plurality of cups 16 are affixed to the undersurface of housing 12.

A cross member 18 is rigidly affixed across the top edges of the side walls of housing 12. Base plate 20 is in turn rigidly affixed to cross member 18. The soap dispenser 22, made of compressible material, rests atop base plate 20. Soap dispenser 22 is compressed by means of movable arm 24, which travels in a guideway formed in guideway block 26.

The handle shaft 28 is mounted in a cylindrical bore 27 of guideway block 26. The handle 30 is integrally attached to handle shaft 28, the axis of the handle 30 lying perpendicular to the axis of the handle shaft 28. Suction cup release lever 32 is rotatably affixed to handle 30.

Figure 2:
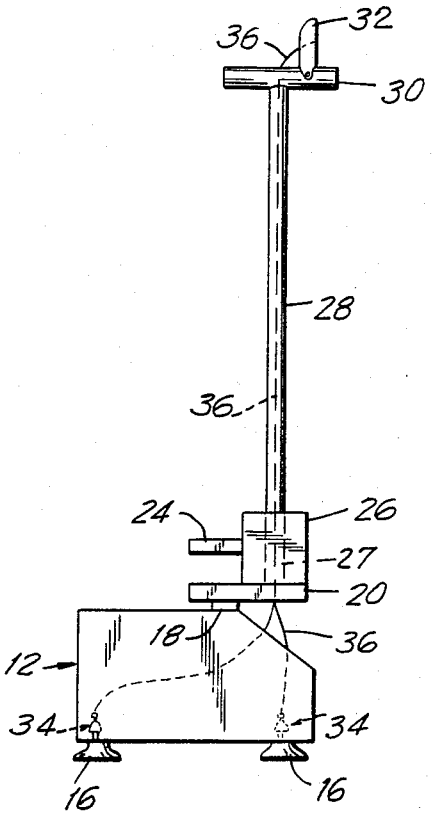
FIG. 2 shows a side view of the foot scrubber depicted in FIG. 1.

In FIG. 2, the valve means associated with each cup 16 is generally denoted by the numeral 34. Together valve means 34 and cup 16 form a releasable suction cup, which is generally denoted by the numeral 44 in FIG. 4.

Suction cup 44 is operatively connected to suction cup release lever 32 by means of release cable 36, (as indicated by the dotted line in FIG. 2) through a bore (not illustrated) in handle shaft 28 and a bore (not illustrated) in base plate 20. In the preferred embodiment, a multiplicity of suction cups 44 are employed to more securely hold housing 12 in place. However, it would be obvious to one skilled in the art to substitute rubber feet (which provide no suction) for some of the suction cups. For example, two suction cups could be provided in the area of the housing undersurface near the handle and two rubber feet could be provided at the end where the foot is inserted, provided, of course, that the gripping power supplied by two suction cups provides sufficient stability.

Figure 3A:
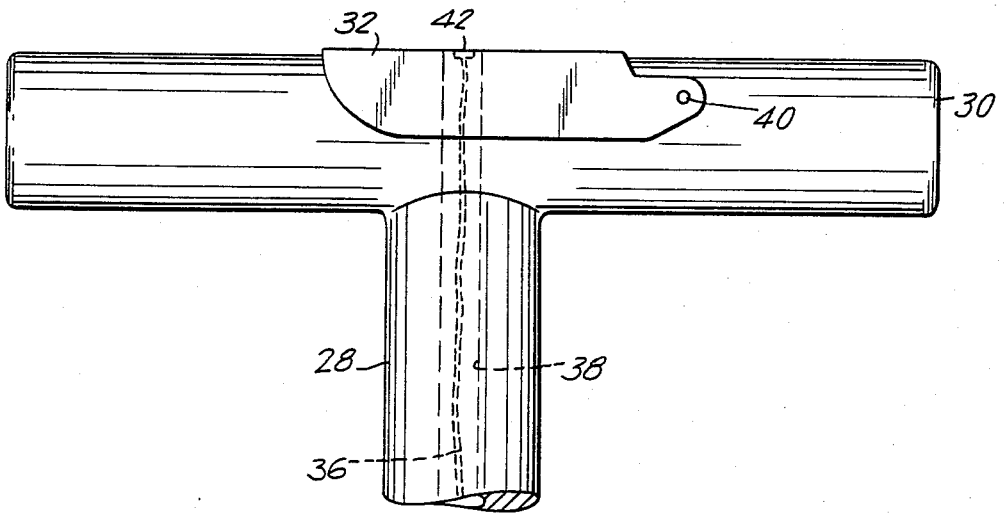
FIGS. 3A and 3B show front views of the foot scrubber handle with the suction cup release lever in closed and open positions, respectively.
Figure 3B:
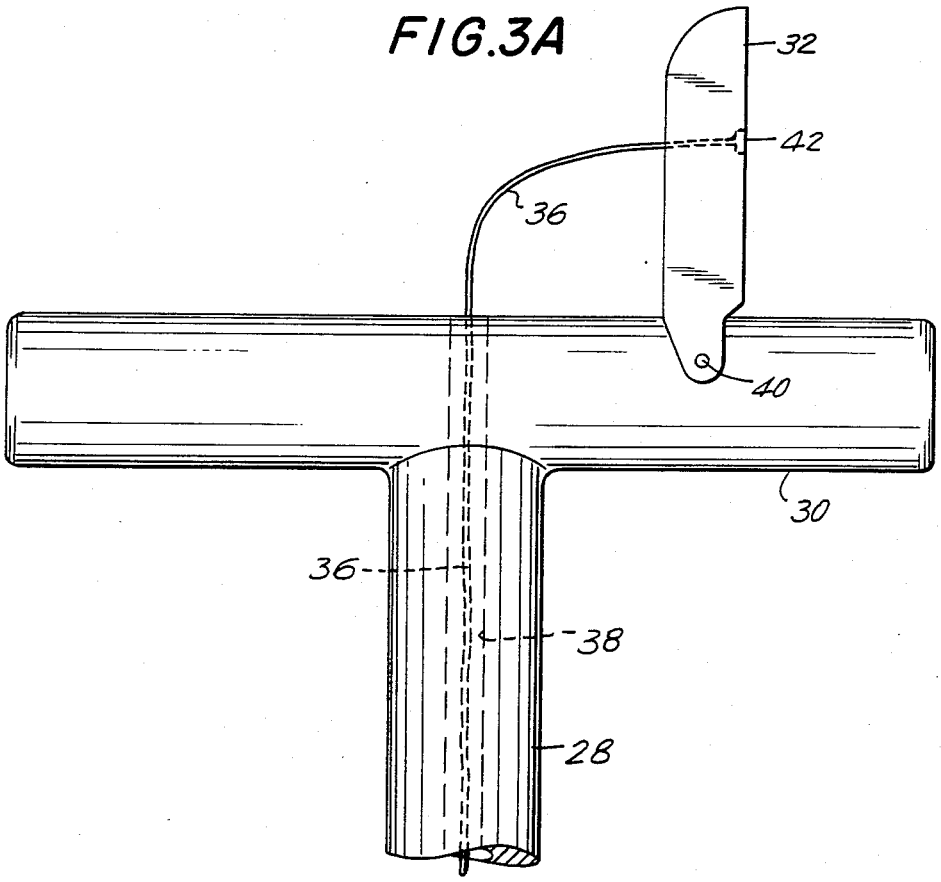

The structure of the handle 30 is shown in detail in FIGS. 3A and 3B. A cylindrical bore 38 passes through handle shaft 38 and handle 30. Suction cup release lever 32 is rotatably affixed to handle 30 by means of pivot pin 40. Release cable 36, which passes through bore 38, is rigidly affixed to suction cup release lever 32 by fastener 42. FIG. 3A shows the suction cup release lever in the closed position. FIG. 3B shows the suction cup release lever 32 in the open position, which position is attained by a rotation of 90 degrees about pivot pin 40.

Figure 4:
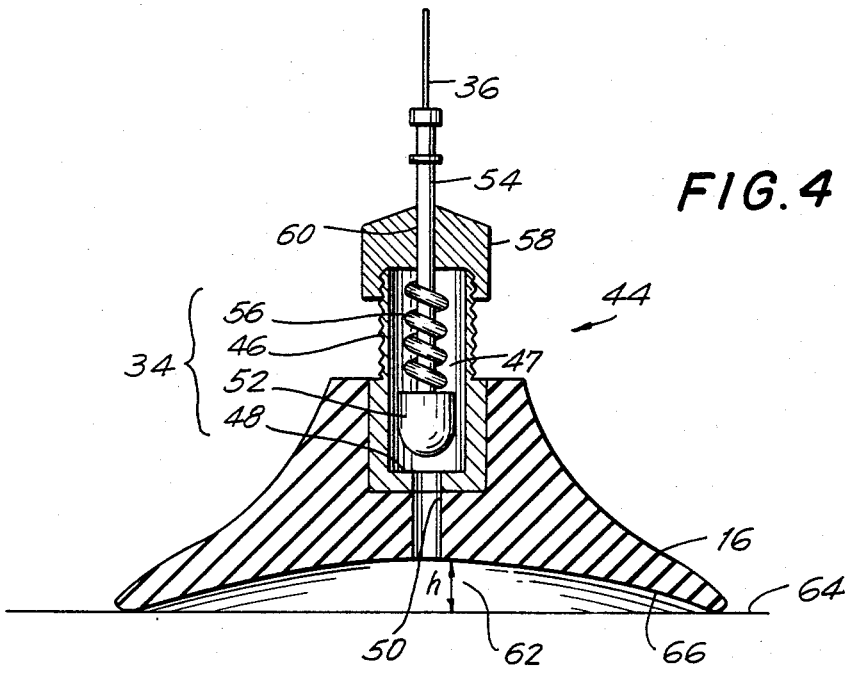
FIG. 4 shows a cross-sectional view of the suction cup which is incorporated in the foot scrubber according to the present invention.

FIG. 4 shows the structure of suction cup 44 in detail. Suction cup 44 attaches to any planar surface via cup 16, which is made of elastic material (e.g., rubber). Suction cup 44 is provided with a valve housing 46, defining a cylindrical valve chamber 47 which is open at the top. The base 48 of valve housing 46 defines valve opening 50. Base 48 serves as the valve seat for valve head 52, which is rigidly affixed to one end of valve stem 54. Valve head 52 is made of elastic material (e.g., rubber). A valve spring 56 is provided, rigidly affixed to valve head 52 and to nut 58. Valve housing 46 and nut 58 are coupled by engagement of the threads on the outside of valve housing 46 with the threaded bore of nut 58. The other end of valve stem 54 is connected to release cable 36. The cylindrical body of valve stem 54 is slidably arranged in bore 60 of nut 58.

FIG. 4 shows valve head 52 displaced from valve seat 48, which corresponds to the open position. In the closed position, valve head 52 sits on valve seat 48, thereby blocking valve opening 50. Valve head 52 is displaceable along the axis of valve stem 54 as valve stem 54 slides in bore 60 of nut 58. When valve head 52 is in the closed position, spring 56 is sufficiently compressed to provide a force which resists movement of valve head 52 away from valve seat 48. When valve head 52 is displaced along the axis of valve stem 54, away from valve seat 48, spring 56 is further compressed, thereby increasing the force exerted by spring 56 correspondingly.

The cup 16 of suction cup 44 is made of elastically deformable material and defines a suction volume 62 when seated on a planar surface 64. Suction volume 62 communicates with the valve chamber 47 via valve opening 50, when valve head 52 is displaced from valve seat 48. In the undeformed state, suction volume 62 has a height h at its highest point. Generally, the surface 66 which defines suction volume 62 will have a shape corresponding to a section of a sphere, with the radius of the sphere being much greater than h. In the fully deformed state (not illustrated), the inner surface 66 is deformed to define a planar surface which is pressed flush against surface 64. In this deformed state, the suction volume 60 is reduced to a value substantially equal to zero.

Figure 5A:
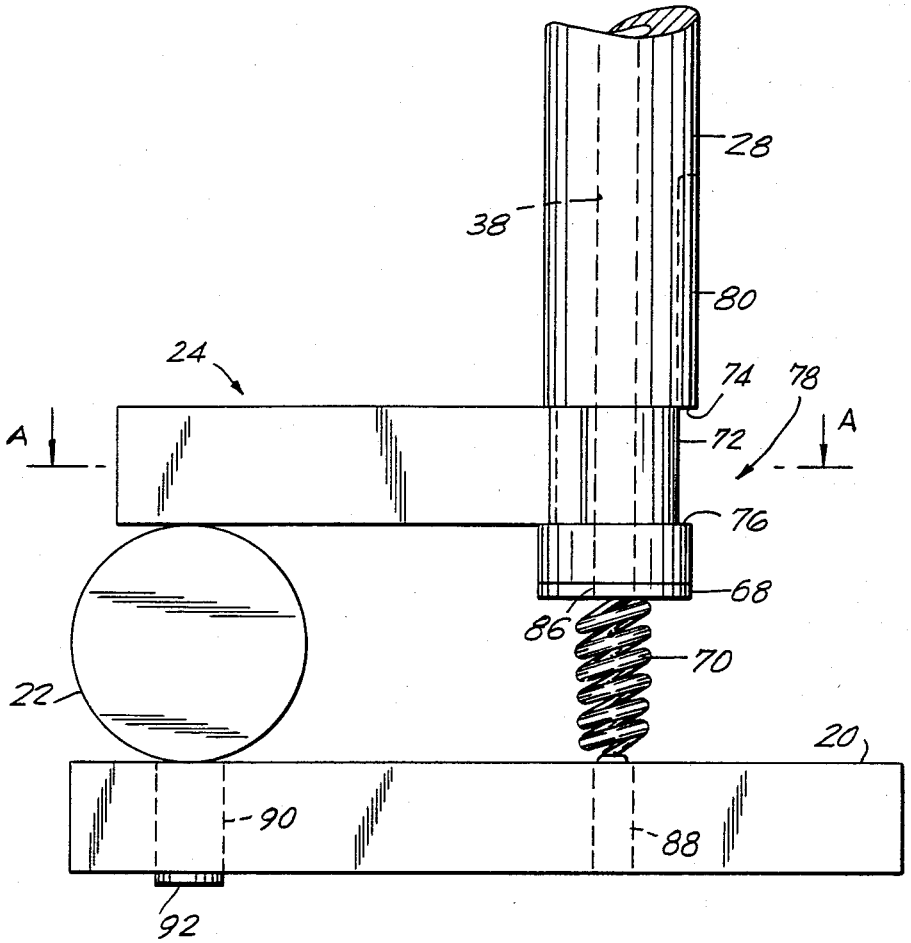
FIG. 5A shows a side view of the handle shaft and cooperating elements, with the guideway block not depicted for the purpose of illustration.

FIG. 5A shows the structure of handle shaft 28 and cooperating elements in greater detail, with the guideway block 26 not depicted for the purpose of illustrating this structure more clearly. During the following discussion, however, it should be borne in mind that handle shaft 28 is slidably arranged in a vertical cylindrical bore (not illustrated) in guideway block 26.

As can be seen in FIG. 5A, the end of shaft 28 is seated on, but not affixed to, mounting plate 68. Thus, handle shaft 28 can rotate about its axis while mounting plate 68 remains stationary. Spring 70 is rigidly affixed to mounting plate 68 at one end and to base plate 20 at the other end. When handle shaft 28 slides in a downward direction inside the vertical bore of, guideway block 26, spring 70 is compressed. The handle shaft 28 has a portion with a cylindrical surface 72 of smaller diameter than that of the rest of the shaft. Cylindrical surface 72 and annular surfaces 74, 76 define circumferential groove 78. The depth of groove 78 is equal to the difference between the radius of handle shaft 28 and the radius of cylindrical surface 72. In the circumferential area of handle shaft 28, above groove 78 and opposite to the area of handle shaft 28 to which movable arm 24 is coupled, an axial groove 80 is provided which communicated with circumferential groove 78. The cross section of axial groove 80 is in the shape of an annular arc of predetermined angular magnitude and having a depth equal to the depth of circumferential groove 78.

Figure 6:
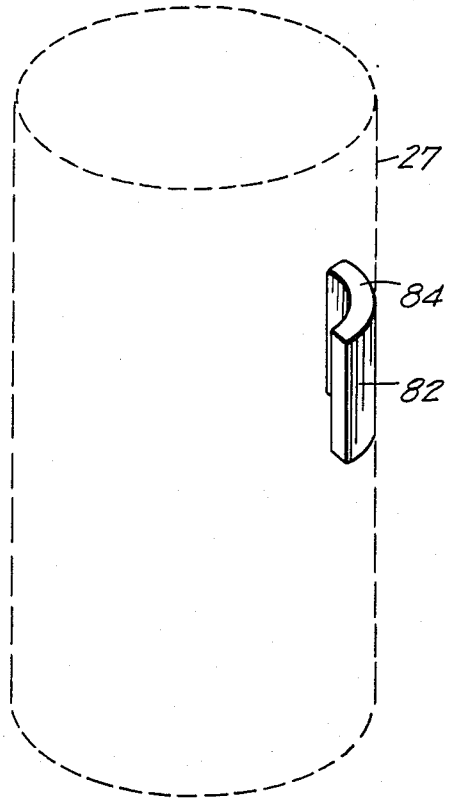
FIG. 6 depicts the position of the tenon integrally formed on the guideway block in relation to the bore defined by the guideway block.

Axial groove 80 serves as a guideway for a tenon 82, (see FIG. 6) constructed integrally with guideway block 26 (not illustrated in FIG. 6) and extending into bore 27 of guideway block 26. This tenon is arranged so that its top surface 84 is vertically aligned with annular surface 74 when spring 70 is in an undeformed state. The cross section of the tenon corresponds exactly to the cross section of axial groove 80. The height of tenon 82 is less than the width of circumferential groove 78, so that tenon does not obstruct rotation of handle shaft 28 about its own axis when top surface 84 of tenon 82 is vertically aligned with annular surface 74. However, because of the abutment of top surface 84 against surface 74, handle shaft 28 cannot be vertically displaced unless tenon 82 is circumferentially aligned with axial groove 80. If tenon 82 and axial groove 80 are properly aligned, then axial groove 80 will slide on tenon 82 as handle shaft 29 is vertically displaced downwardly.

Returning to FIG. 5A, it can be seen that a plurality of bores are provided through which release cable 36 (not illustrated in FIG. 5A) passes. Bore 38 of handle shaft 28 communicates with bore 86 of mounting plate 68. Further, bore 88 is provided in base plate 20. Base plate 20 has another bore 90 in which the outlet port 92 of soap dispenser 22 is inserted. Movable arm 24 is coupled to handle shaft 28, extending horizontally to contact the top of soap dispenser 22.

Figure 5B:
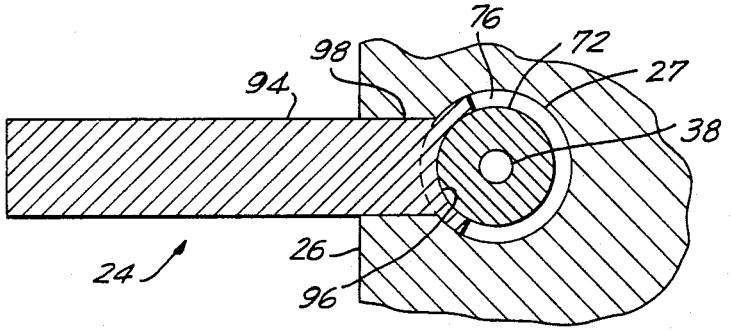
FIG. 5B is a cross-sectional view taken along section A—A of FIG. 5A.

FIG. 5B shows a cross-sectional view of movable arm 24, handle shaft 28, and guideway block 26, taken along section A—A. Movable arm 24 comprises bar 94 and arm tenon 96 integrally formed. The cross section of arm tenon 96 is in the shape of an annular arc having a depth equal to that of tenon 82. However, the angular magnitude of the arc defined by arm tenon 96 is greater than that of the arc defined by groove 80, thereby precluding groove 80 from traveling on arm tenon 96 in the event that they become circumferentially aligned. As can be seen in FIG. 5B, the inner surface of arm tenon 96 contacts cylindrical surface 72 of handle shaft 28. Bar 94 of movable arm 24 is held circumferentially fixed by the walls of slot 98 formed in guideway block 26. However, when handle shaft 28 is displaced vertically in bore 27, movable arm 24 coupled to handle shaft 28 is also displaced vertically, with bar 94 traveling along slot 98. Thus, bore 27 and slot 98 communicate to form a guideway, along which movable arm 24 and handle shaft 28 travel during axial displacement.

Figure 7:
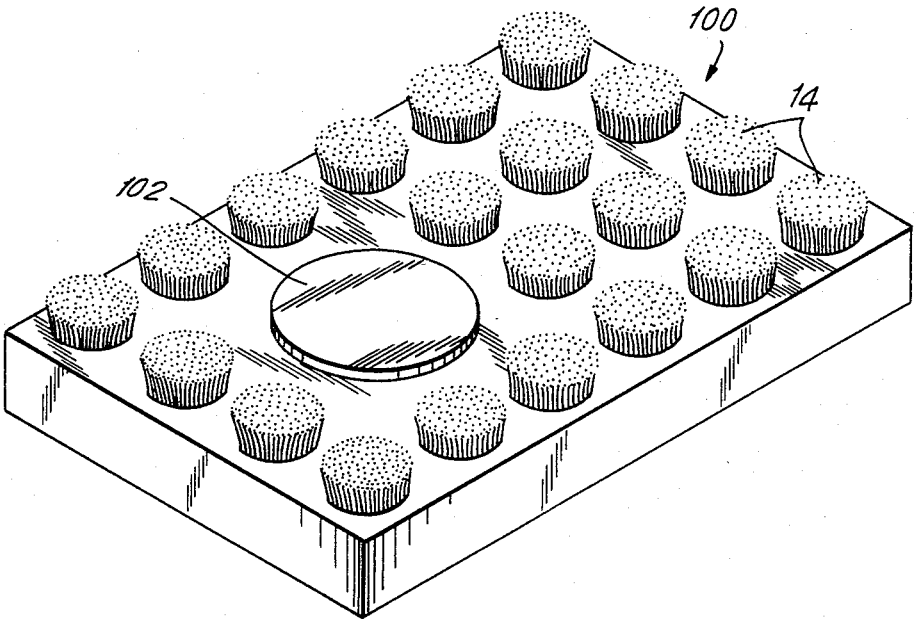
FIG. 7 shows a perspective view of the bottom plate of the housing according to the present invention.

FIG. 7 shows bottom plate 100 of housing 12 with brushes 14 arranged thereon. The surface of bottom plate 100 is provided with a soap catcher 102, which comprises a raised concave surface on which dispensed soap may accumulate.

Figure 8:
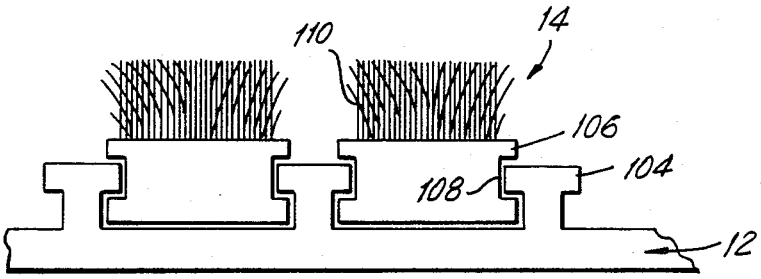
FIG. 8 is an end view of the tracks which hold the brushes in place on the housing according to the present invention.

FIG. 8 depicts the manner in which brushes 14 are arranged on the housing 12. Rails 104 of T-shaped cross section are formed integrally with housing 12. Confronting flanges of adjacent rails define a track along which a row of brushes 14 can be inserted. Each brush 14 comprises a cylindrical base 106 having a circumferential groove formed thereon and a plurality of bristles 110, one end of each bristle being rigidly affixed to base 106. The brushes are held in place during use by a stop at one end of the track and removable pegs at the other end in a manner well known in the art.

The above-described arrangement whereby brushes 14 are inserted along tracks 114 are inserted along tracks formed on the inner surfaces of housing 14 enables the user to remove the brushes for the purpose of removing worn brushes or cleaning dirty brushes. Also, the user may insert brushes of predetermined texture in accordance with his requirements.

In order to operate the foot scrubber according to the present invention, the first requirement is to place the scrubber firmly secured, in the desired position in the tub or shower stall without the user bending his or her back. This is achieved by raising the lever 32 (FIG. 3B) on the handle to open valve opening 50 (FIG. 4). Once properly positioned, the lever 32 is lowered (FIG. 3A) to close the valve opening 50. The attachment of the foot scrubber onto a flat surface is achieved by means of one or a multiplicity of suction cups 44, which are firmly pressed against the target surface 64 (see FIG. 4) thereby deforming cup 16. As downward force is applied, inner surface 66 of cup 16 is deformed and the height h of suction volume 62 approaches zero. When valve head 52 is positioned on valve seat 48, thereby closing valve opening 50, and when internal surface 66 is pressed snugly against the target surface 64, a partial vacuum is formed by which the suction cup 44 is held tightly against surface 64. Since suction cup 44 is rigidly affixed to housing 12, the foot scrubber is held securely relative to surface 64.

As can be seen in FIG. 2, the user can produce the required downward force to secure the suction cup 44 by applying downward pressure on handle 30. Of course, it is understood that this should be done when tenon 82 is not circumferentially aligned with axial groove 80. If tenon 82 and groove 80 were aligned at the time of application of downward force, then axial groove 80 would travel on tenon 82, thereby compressing soap dispenser 22 by means of downwardly moving arm 24. This would result in the accidental issuance of soap during attempted securement of the suction cup 34. By rotating handle 30 (and handle shaft 28) so that tenon 82 and groove 80 are not circumferentially aligned, then annular surface 74 (see FIG. 5A) abuts top surface 84 (see FIG. 6), thereby locking the handle shaft 28 in place relative to guideway block 26 and preventing vertical displacement of movable arm 24. Thus, any downward force exerted on handle 30 will be transferred to suction cup 44 by way of the rigidly connected handle shaft 28, guideway block 26, base plate 20, support cross member 18, and housing 12.

Although the preferred embodiment as described herein comprises four suction cups 44 positioned substantially at the four corners of housing 12, it would be obvious to one skilled in the art to provide fewer suction cups, each removed suction cup being replaced by a simple rubber foot.

Once the foot scrubber has been stably secured to the floor of the bathtub or shower stall, the user is ready to wash his feet. After rinsing the foot scrubber with water, liquid soap is deposited on soap catcher 102 of bottom plate 100. This is accomplished by rotating handle 30 until groove 80 and tenon 82 are circumferentially aligned. The user can perform this task by aligning a pair of arrowheads (not shown), one applied to the surface of handle shaft 28 and the other applied to guideway block 26 in a known way. The arrowheads are arranged so that their tips exactly align when axial groove 80 and tenon 82 are exactly aligned circumferentially.

When axial groove 80 and tenon 82 are properly aligned, the user applies downward pressure on handle 30. Handle shaft 28 is thereby displaced downwardly as groove 80 travels on tenon 82 of guideway block 26. In the meantime, circumferential groove 78 engages arm tenon 96, thereby coupling movable arm 24 to handle shaft 28. Thus, movable arm 24 (i.e., bar 94) is displaced in a downward direction as handle shaft 28 moves downwardly. As movable arm 24 (i.e. bar 94) is displaced, soap dispenser 22 is compressed. Liquid soap is forced out of soap dispenser 22 via outlet port 92 during compression. It will be noted that outlet port 92 may be provided with a diaphragm (not illustrated) which operates in a known manner to prevent escape of liquid soap except when a predetermined threshold of pressure is exceeded. Thus, liquid soap will not pass through outlet port 92 under the influence of gravity alone.

The liquid soap dispensed via outlet port 92 as a result of manipulation of handle 30 will fall under the influence of gravity, forming a puddle on soap catcher 102. After the soap has been dispensed, the handle shaft 28 is returned to its original position by displacement upwardly until top surface 84 of tenon 82 is vertically aligned with annular surface 74. Then handle shaft 28 is rotated in either direction as circumferential groove 78 travels on tenon 82. It should be noted that the height of tenon 82 is substantially equal to the width of circumferential groove 78, as a result of which handle shaft 28 has no vertical play (i.e., cannot move up or down) when tenon 82 engages groove 78.

Using handle 30 for support, the user next inserts a foot in between the sidewalls of housing 12 and onto bottom plate 100, where the liquid soap in soap catcher 102 contacts the bottom of the user's foot. Although handle 30 can be rotated about the axis of handle shaft 28, it cannot be displaced vertically because tenon 82 and circumferential groove 78 are engaged. Thus, the user can maintain proper balance by holding handle 30 on both sides of handle shaft 28.

The process by which soap is dispensed in then repeated, thereby applying liquid soap to the top of the user's foot. By appropriate movements of the foot, the user can scrub the various portions of his foot with the brushes 14 affixed to the side walls and bottom plate of housing 12. After the foot has been suitably cleansed, the foot is removed from the foot scrubber and rinsed. Then the process is repeated with the other foot.

After both feet have been cleansed and the foot scrubber has been rinsed, the user rotates suction cup release lever 32 about pivot pin 40 by 90° (see FIG. 3B). Release cable 36, which is rigidly attached to release 32 by fastener 42, is pulled in an upward direction throughout its length. As a result, valve stem 54, connected to release cable 36, is raised, thereby displacing valve head 52 from valve seat 48. Valve opening 50 is uncovered, allowing air from valve chamber 47 to pass through, which removes the partial vacuum established during deformation of cup 16. Inner surface 66 rises as air from valve chamber 47 fills suction volume 62, and suction cup 44 no longer grips surface 64. The foot scrubber can then be easily removed by lifting via handle 30.

Thus, the apparatus of the present invention can be operated by appropriate manipulations of handle 30 without the user bending at the back.

The above description of the preferred embodiment is presented for illustrative purposes only and is not intended to limit the scope of the present invention as claimed in the appended claims. It will be understood that modifications and variations may be effected without departing from the scope of the inventive concept herein disclosed. For example, instead of providing the handle shaft 28 with a circumferential groove 78 and an axial groove 80 which ride on tenon 82 of guideway block 26, a slot could be provided adjacent to slot 98 in which bar 94 of movable arm 24 could be locked vertically, thereby preventing accidental dispensation of soap. In addition, the soap dispenser could be a pump type rather than a compressible container. The incorporation of other equivalent elements is within the capability of those having ordinary skill in the art.

What is claimed is:

1. A foot scrubber comprising:

(a) a frame comprising two substantially parallel sidewalls and a bottom plate supporting said sidewalls;

(b) support means mounted on said sidewalls;

(c) scrubbing means arranged on said bottom plate and on said sidewalls;

(d) a first suction means mounted on said bottom plate for affixing said frame to a surface by suction;

(e) compressible storage means removably mounted on said support means for storing liquid soap, having an outlet directed for dispensing liquid soap onto said bottom plate only in response to the application of pressure on said compressible means;

(f) linearly displaceable pressing means arranged to apply pressure on said compressible storage means by downward displacement;

(g) manually operable means including a handle rigidly connected to a shaft, said manually operable means being rotatable about and displaceable along the axis of said shaft; and (h) guiding means for guiding said pressing means and said manually operable means during displacement, wherein said manually operable means has recesses formed therein, and said pressing means and said guiding means each have engaging means formed thereon for engaging said recesses, said recesses being arranged so that said pressing means are displaced downward during downward displacement of said manually operable means, said manually operable means being displaceable downward only when said handle is in a predetermined angular position with respect to said guiding means.

2. A foot scrubber as defined in claim 1, wherein said recesses comprise an axially directed recess and an annular recess communicating therewith, said engaging means of said pressing means being engageable with said annular recess and said engaging means of said guiding means being engageable with said annular recess and said axially directed recess.

3. A foot scrubber as defined in claim 2, wherein said engaging means comprise tenons formed to slidably travel in said recesses.

4. A foot scrubber as defined in claim 1, wherein said guiding means has a slot and a bore formed therein, said slot communicating with said bore, said pressing means being slidably arranged in said slot and said shaft being slidably and rotatably arranged in said bore.

5. A foot scrubber as defined in claim 1, wherein said first suction means comprises a valve means, said first suction means being adapted to produce a partial vacuum thereunder only when said valve means is in a closed condition.

6. A foot scrubber as defined in claim 5, further comprising a release means rotatably arranged on said handle, said release means being connected to said valve means by a wire such that said valve means is placed in an opened condition when said release means is rotated to a predetermined angular position, thereby releasing the partial vacuum formed under said valve means.

7. A foot scrubber as defined in claim 6, wherein said shaft has a bore formed therein, said wire being arranged in said shaft bore.

8. A foot scrubber as defined in claim 1, further comprising second through fourth suction means, said bottom plate being rectangular and said first through fourth suction means being mounted at the four corners of said bottom plate.

9. A foot scrubber as defined in claim 1, wherein said scrubbing means comprises a plurality of brushes.

10. A foot scrubber as defined in claim 9, wherein said bottom plate and said sidewalls have a plurality of substantially parallel T-shaped rails integrally formed thereon, and each of said brushes has a base with a circumferential groove for slidably engaging a pair of said rails during insertion.

11. A foot scrubber as defined in claim 1, wherein said bottom plate has a shallow recess formed therein for collecting liquid soap.

* * * * *